United States Patent [19]

Arnett

[11] Patent Number: 5,041,018

[45] Date of Patent: Aug. 20, 1991

[54] ELECTRICAL CONNECTOR RECEPTACLE

[75] Inventor: Jaime R. Arnett, Noblesville, Ind.

[73] Assignee: AT&T Bell Laboratories, Murray Hill, N.J.

[21] Appl. No.: 569,303

[22] Filed: Aug. 20, 1990

[51] Int. Cl.[5] ..... H01R 13/74

[52] U.S. Cl. ..... 439/536; 439/557; 439/676

[58] Field of Search ..... 439/557, 567, 536, 558, 439/911, 552–556; 248/27.3

[56] References Cited

U.S. PATENT DOCUMENTS

| | | | |
|---|---|---|---|
| D. 283,979 | 5/1986 | Arnett et al. | D8/350 |
| 3,366,729 | 1/1968 | Pauza | 248/27.3 |
| 3,824,524 | 7/1974 | Glover | 439/282 |
| 4,269,467 | 5/1981 | Hughes | 339/126 |
| 4,477,141 | 10/1984 | Hardesty | 339/122 |
| 4,580,859 | 4/1986 | Frano et al. | 439/557 |
| 4,711,507 | 12/1987 | Noorily | 439/557 |
| 4,725,249 | 2/1988 | Blackwood et al. | 439/535 |
| 4,820,192 | 4/1989 | Denkmann et al. | 439/404 |
| 4,859,201 | 8/1989 | Marsh | 439/290 |

FOREIGN PATENT DOCUMENTS

| | | | |
|---|---|---|---|
| 6609509 | 1/1967 | Netherlands | 439/557 |
| 2104735 | 3/1983 | United Kingdom | 439/557 |

*Primary Examiner*—Gary F. Paumen
*Attorney, Agent, or Firm*—Michael A. Morra

[57] ABSTRACT

An electrical connector receptacle, of the telephone jack type, includes a housing of dielectric material having an opening into a plug-receiving cavity in its front end. The receptacle further includes cantilever flexible mounting members on opposite side surfaces thereof which are adapted to deflect into the plug-receiving cavity when the receptacle is inserted or removed from an appropriately-dimensioned opening in an associated coverplate. In one embodiment, the flexible mounting members include wedge-shaped protrusions that interact with the coverplate to deflect the flexible mounting members into the cavity. In this embodiment, the receptacle further includes a stop member that prevents it from being pushed completely through the opening in the coverplate. In another embodiment, the flexible mounting members include holes that mate with protrusions in the coverplate. In this embodiment, a stop member is not required. In all embodiments, the presence of a plug within the plug-receiving cavity precludes the flexible mounting members from deflecting into the cavity and thus interlocks the receptacle and coverplate together.

8 Claims, 5 Drawing Sheets

ELECTRICAL CONNECTOR RECEPTACLE

TECHNICAL FIELD

This invention relates to the physical design of an electrical connector receptacle and more particularly to a communications receptacle designed to quickly connect to a coverplate.

BACKGROUND OF THE INVENTION

Telecommunications equipment has benefited from the design of electrical plugs and jacks that provide easy connect/disconnect capability between electrical circuits within the telecommunications equipment and, for example, local network wiring. Such plugs and jacks are particularly popular in association with telephone sets where they were first used. Indeed, so-called modular plugs and jacks have been so well received, that their specifications are standardized and can be found in Subpart F of the FCC-Part 68.500 Registration Rules. So widespread has the use of these devices become that new houses now come pre-wired with jacks in nearly every room to accommodate communication equipment. Similar to power receptacles, communication receptacles (jacks) require some type of coverplate for reasons of safety and aesthetics. It is therefore desirable to attach jacks and coverplates with minimum inconvenience and cost.

One technique for attaching a jack to a coverplate is disclosed in U.S. Pat. No. 4,477,141 issued on Oct. 16, 1984 in the name of E. C. Hardesty. In this patent, the coverplate includes latching tabs molded into the back side thereof that are designed to be received within mating grooves contained within the jack. The coverplate further includes an alignment fence also molded into the back side for support of the jack. The use of such complex coverplates is undesirable, not only from a cost standpoint, but also because coverplates having special jack support features molded therein are unlikely to be used in other applications. Furthermore, since the lateral movement of the latching tabs is not restrained, the jack and coverplate can become separated when force is applied to the jack.

Another technique for attaching a jack to a coverplate is disclosed in U.S. Pat. No. 4,859,201 which issued on Aug. 22, 1989, in the name of E. K. Marsh. In this patent, a flexible latching structure is molded into at least the top side of the jack, which enables the use of a coverplate that is generally flat. Additionally, the jack is easily snapped into a generally-rectangular opening in the coverplate. However, like the Hardesty reference, movement of the flexible latching structure is not restrained, so the jack is likely to become disconnected from the coverplate when a plug is pressed into the jack.

In yet another technique, grooves are molded into opposite sides of the jack in order to receive a collar fastener after the jack has been inserted into the coverplate—much like a retaining washer. The jack is inserted through an opening in the back side of the coverplate, and the collar is positioned onto the grooves of the jack from the front side of the coverplate. The jack and coverplate are now firmly locked together so long as the collar remains in place. However, the use of additional parts, such as a collar, is undesirable because the number of parts is increased and additional labor is required. Further, should the collar become detached after installation, use of the jack would be cumbersome at best. It is therefore desirable to provide a jack that easily and securely attaches to a simple coverplate without the use of additional parts.

SUMMARY OF THE INVENTION

An electrical connector receptacle includes a housing of dielectric material having a plug-receiving cavity in its front end. The receptacle further includes a flexible member that interacts with a coverplate during insertion or removal of the receptacle. When the receptacle is inserted into the coverplate, the flexible member deflects into the cavity. Consequently, the insertion of a plug into the cavity precludes deflection of the flexible member and thus keeps the receptacle from disengaging the coverplate.

In some illustrative embodiments of the invention, each flexible member includes a wedge-shaped protrusion that interacts with the opening of the coverplate to deflect the flexible member into the cavity. In these embodiments the receptacle further include a stop member for halting progression of the receptacle through the coverplate during insertion. The protrusion and the stop member cooperate to hold the receptacle and coverplate together.

In another illustrative embodiment of the invention, each flexible member includes an opening therein for receiving a mating protrusion in the opening of the coverplate. In this embodiment, a stop member is not required.

In preferred embodiments of the invention, the flexible members comprise cantilever beams, each having a free end and a fixed end. The cantilever beams are positioned on opposite side surfaces of the receptacle.

DETAILED DESCRIPTION

Figure 1:
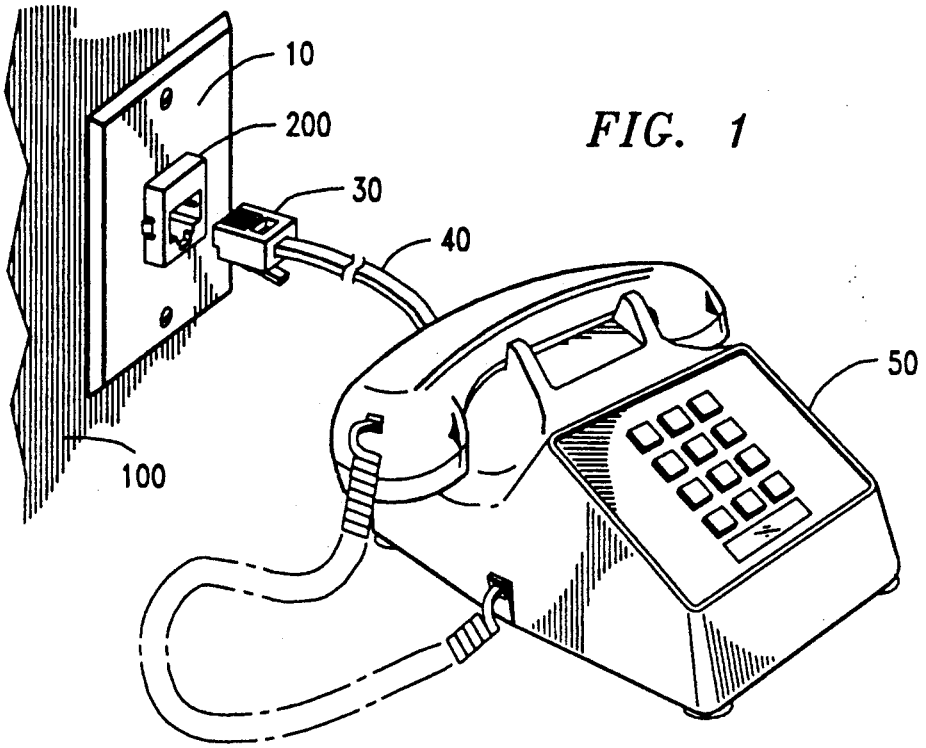
FIG. 1 illustrates an electrical connector receptacle in accordance with the invention for use with telecommunications equipment.
Figure 2:
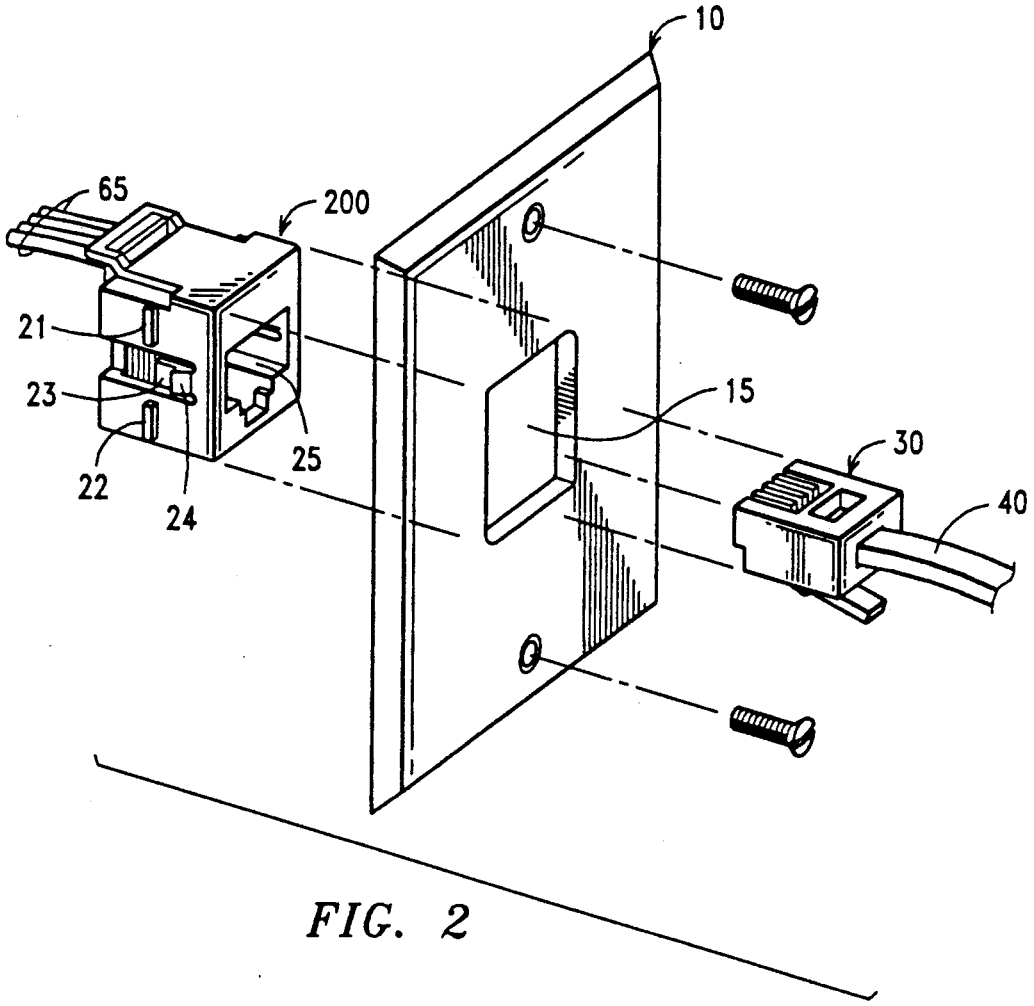
FIG. 2 is an exploded view of an assembly comprising the electrical connector receptacle together with a coverplate and a telephone plug showing their interconnection.

Modular plugs and jacks provide a convenient means for connecting and disconnecting telephone equipment such as shown in FIG. 1. In this figure, a conventional telephone set 50 is shown equipped with a cord 40 terminated in a modular plug 30. A communication outlet, comprising a coverplate 10 and an electrical connector receptacle 200 is shown mounted on wall surface 100. Communication receptacle 200 is frequently referred to as a modular jack and offers easy access to a telecommunications network. Jack 200 typically includes 4 wires; although as few as 2, or more than 8 wires are not uncommon. Nevertheless, as home and business communication needs increase, so too will the number of outlets that service this need. Unlike AC power receptacles, communication receptacles are low voltage, low power devices that present little safety threat. Indeed, modular jacks need not be firmly mounted to a wall box before a coverplate is attached; but rather may be mounted on the coverplate itself without more. Using an exploded view, FIG. 2 generally illustrates the cooperation between the various parts of a communications outlet. House wiring 65, associated with communications, terminates in jack 200 which includes a cavity 25 in its front end for receiving a modular plug 30 and for making electrical interconnections therebetween. Coverplate 10 is a generally planar structure that includes opening 15 for receiving jack 200 which is inserted from the back side thereof. As shown, telephone cord 40 and modular plug 30 are inserted from the front side of coverplate 10. During installation, jack 200 is pushed through opening 15 until stop members 21, 22 inhibit further advancement. Flexible member 23 includes a wedge-shaped tab 24 for latching the jack into place. The shape of opening 15 in coverplate 10 corresponds to the shape of jack 200, and sized to interact with the wedge-shaped tab 24 so that the jack will easily snap into the opening 15 but not out of it. Flexible member 23 deflects into cavity 25 of jack 200 during installation. Since the dimensions of the modular plug 30 are nominally the same as those of the cavity, with suitable clearance, flexible member 23 is precluded from being deflected into the cavity during insertion of the modular plug into the cavity or while the modular plug remains therein. Therefore the coverplate remains captured between stop members 21, 22 and tab 24 of jack 200. It is noted that jack 200 is symmetrical and includes an additional flexible member having a tab as well as stop members positioned on the opposite surface of the one shown in FIG. 3.

Figure 3:
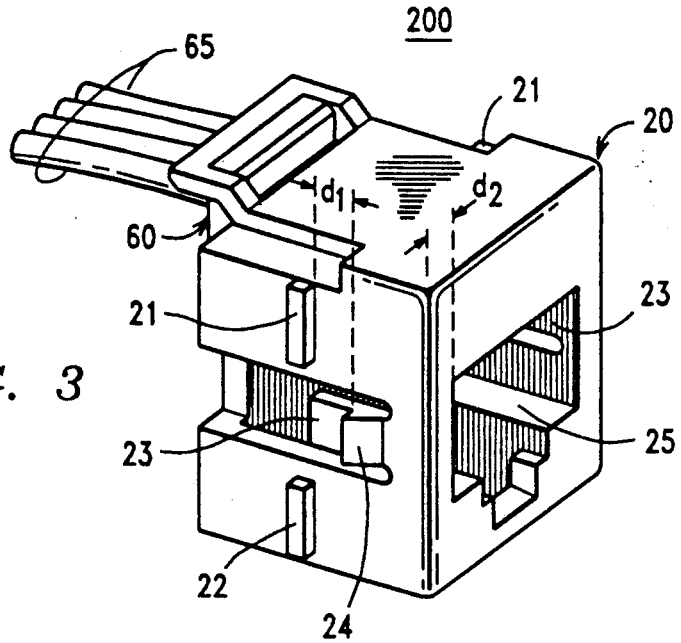
FIG. 3 is a front perspective view of the electrical connector receptacle showing its construction in detail.

FIG. 3 provides greater detail regarding the physical design of jack 200 which is molded from a dielectric material such as ABS (acrylonitrile butadiene styrene). Flexible members 23 are cantilever beams that each include a wedge-shaped tab 24 for easy insertion and latching. Wedge-shaped tab 24 has a front portion and a wider back portion that are directionally aligned with the front and back ends of the jack, which is to say that the front portion of the tab is near the front end of the jack while the back portion of the tab is near the back end of the jack. This facilitates the insertion of jack 200 into the coverplate, but hinders its removal therefrom. For ease of molding in this preferred embodiment, stop members 21, 22 are not located on the cantilever beam itself, but rather are positioned above and below it. Instead of molding stop members into the side surfaces of the jack, its top and bottom surfaces could have been used. So that jack 200 properly engages an associated coverplate, it is important that the edges of the stop members reside in a first plane while the edge of tab 24 and its symmetrical counterpart resides in a second plane. The first and second planes are separated by distance $d_1$ which is approximately equal to the thickness of the coverplate—typically 0.080 inches. Flexible member 23 has a thickness $d_2$ which is sufficiently thick for rigidity but sufficiently thin for flexibility. For the ABS material used, a value of $d_2$ equal to 0.040 inches is suitable. As indicated in FIG. 3 thickness $d_2$ also corresponds to thickness of the sidewalls of the jack.

Figure 4:
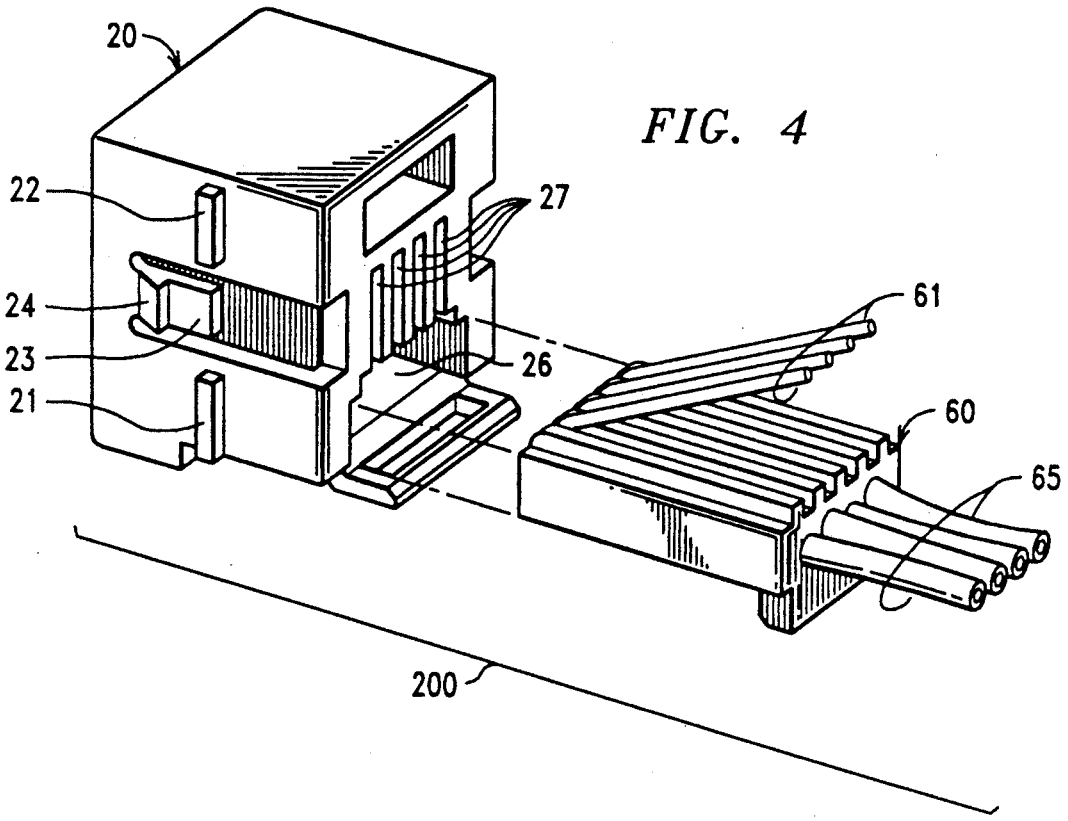
FIG. 4 is a back perspective view of the electrical connector receptacle, comprising a jack frame and a spring block, showing its construction in detail.

FIG. 4 discloses a back view of jack 200 illustrating its construction. Jack 200 comprises jack frame 20 and spring block 60. Spring block 60 is a device, illustratively molded from ABS, which is used to support wires 65 terminated in spring contacts 61 made, for example, from phosphor bronze metal. The spring block is shaped to fit into opening 26 of jack frame 20. Spring contacts 61 fit into vertical, comb-like teeth 27 which are molded into the jack frame and operate to hold the spring contacts in a fixed position for making electrical contact with the wires of a modular plug inserted into the cavity 25 (see FIG. 3) located on the opposite side of jack frame 20.

Figure 5:
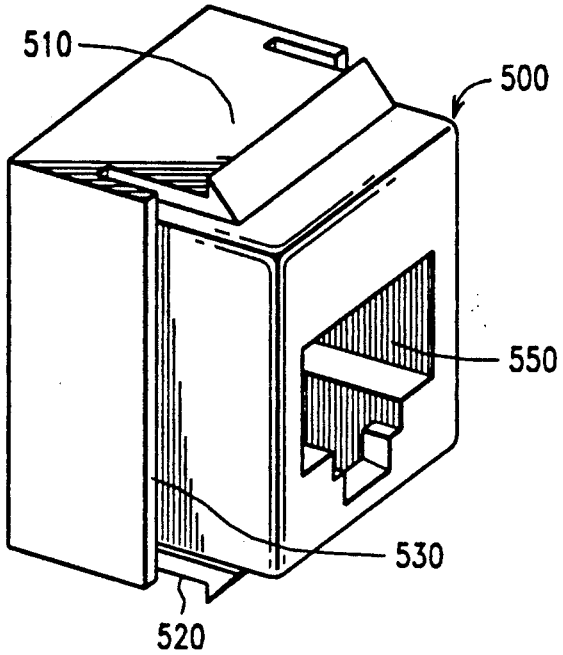
FIG. 5 (PRIOR ART)
FIG. 5 discloses a prior art electrical connector receptacle that includes latching tabs on its top and bottom surfaces.

One known prior art device, shown in FIG. 5 is disclosed in greater detail in U.S. Pat. No. 4,859,201 issued to E. K. Marsh on Aug. 22, 1989. This jack frame 500 includes latching structures 510,520 which are molded into the jack frame itself. The latching structures are designed to snap into a coverplate. Retaining wall 530 stops the forward progression of jack 500 through the coverplate. Although this design offers the desired quick-connect feature, when a modular plug is inserted into opening 550 thereof, jack 500 frequently disconnects from the associated coverplate because the latching structures 510,520 are not restrained from flexing toward each other. The insertion of wedge-shaped parts between the latching structures 510, 520 and the body of the jack 500 would alleviate this problem, but would add yet another part whose is not self evident to a first-time user, and might easily be lost or used improperly.

Figure 6:
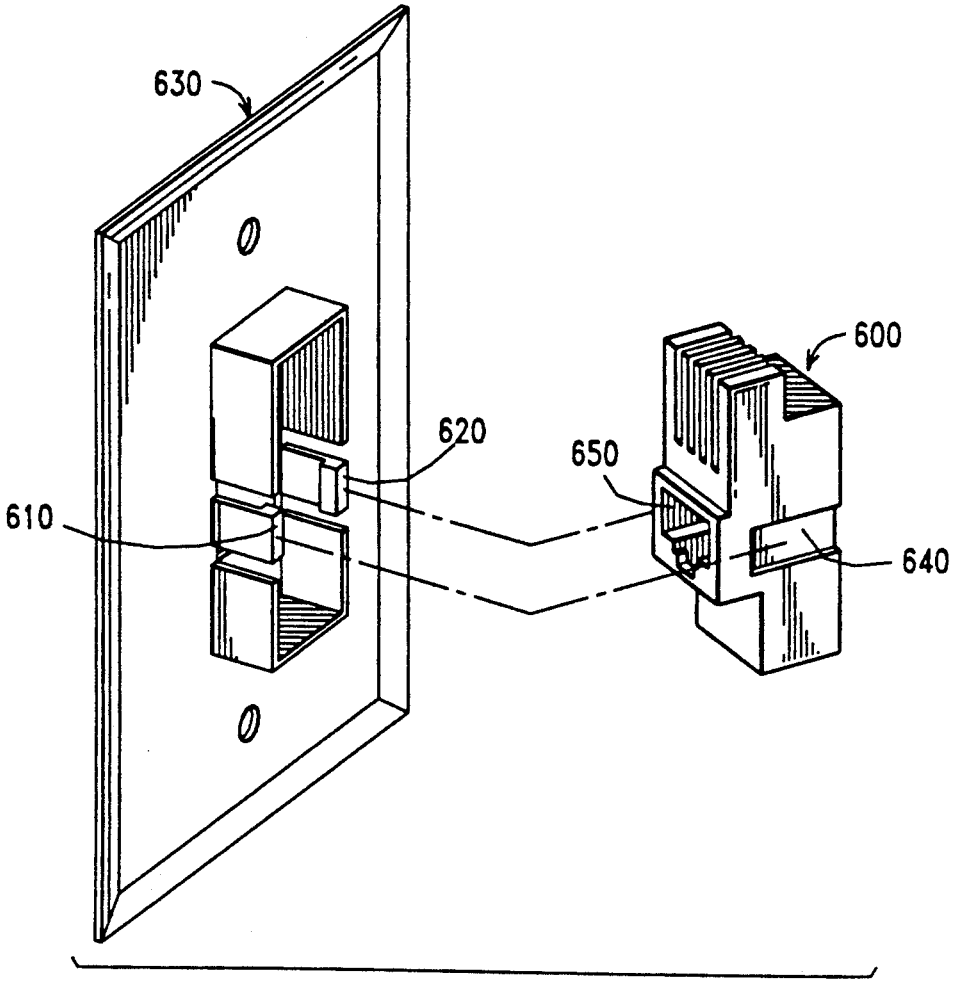
FIG. 6 (PRIOR ART)
FIG. 6 discloses a prior art electrical connector receptacle that cooperates with a specially molded coverplate to remain attached.

Another known prior art device, shown in FIG. 6 is disclosed in greater detail in U.S. Pat. No. 4,477,141 issued to E. C. Hardesty on Oct. 16, 1984. In this patent, latching structures 610,620 are molded into coverplate 630 and cooperate with mating indentations 640 on jack 600 to hold the jack and coverplate together. When a modular plug is inserted into cavity 650 of the jack, the jack frequently disconnects from the coverplate because latching structures 610,620 are not restrained from flexing away the jack. Additionally, coverplate 630 is specially designed and has limited use.

Figure 7:
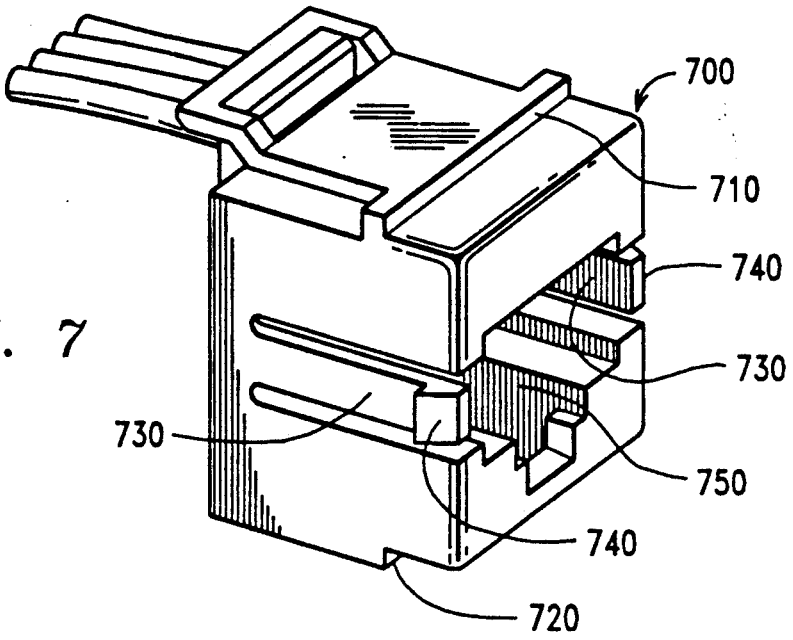
FIG. 7 discloses a second embodiment of the electrical connector receptacle in accordance with the invention.
Figure 8:
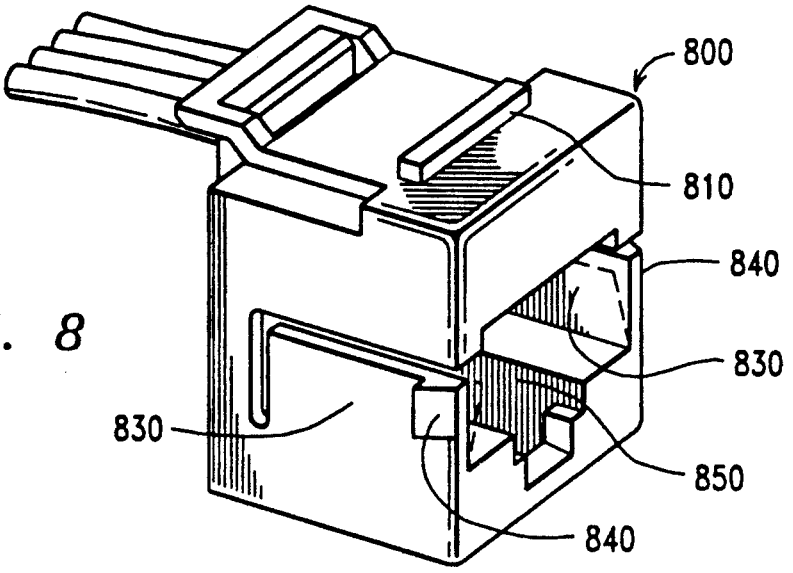
FIG. 8 discloses a third embodiment of the electrical connector receptacle in accordance with the invention.

Alternative embodiments of the present invention are disclosed in FIG. 7 and 8. Referring first to FIG. 7, jack 700 illustrates the use of a cantilever flexible member 730 having a fixed end that is located at the back end of the jack. Similar to the other illustrative embodiments of the invention, flexible member 730 includes a protrusion 740 which not only participates in locking the jack to an associated coverplate, but also urges the flexible member into the plug-receiving cavity 750 in response to attempts to separate the jack/coverplate assembly. Naturally, when a plug is inserted into the cavity 750, it prevents flexible member 730 from deflecting into the cavity. Protrusion 740 is wedge-shaped to facilitate easy connection between the jack and coverplate, and to retard disconnection of same. The stop members denoted 710,720 are now incorporated into the shape of jack 700 in a manner that simplifies mold design. Here, stop members 710, 720 are walls in the top and bottom surfaces of the jack that reside in a first plane that is parallel to, but spaced-apart from, a second plane that passes through the back edge of wedge-shaped protrusion 740. The first and second planes are separated by a distance that equals the thickness of the associated coverplate.

Referring now to FIG. 8, another embodiment of the invention is disclosed in which flexible member 830 is a cantilever beam having a fixed end toward the bottom of jack 800. It too, includes a wedge-shaped protrusion 840 that is designed to make contact with the sides of an opening in a coverplate and deflect inwardly (into cavity 850). Stop member 810 functions to preclude the jack from being pushed completely through the opening in a coverplate during assembly.

Figure 9:
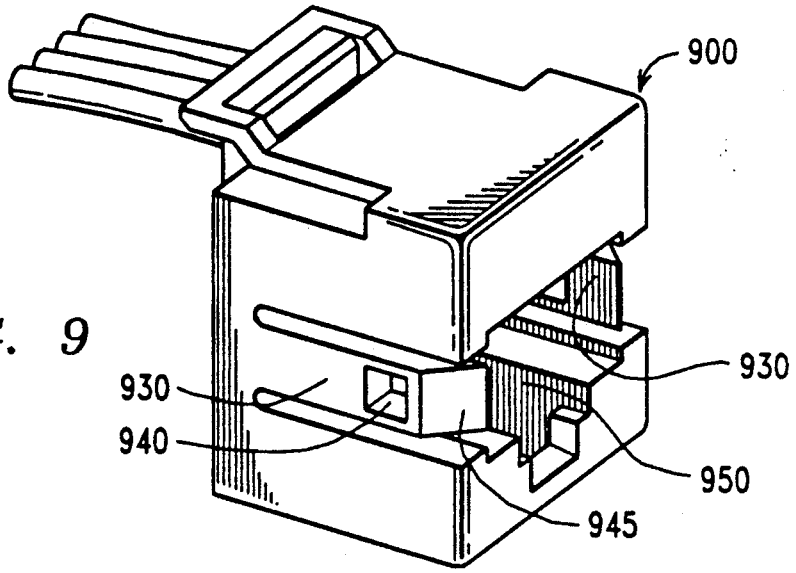
FIG. 9 discloses a fourth embodiment of the electrical connector receptacle in accordance with the invention.
Figure 10:
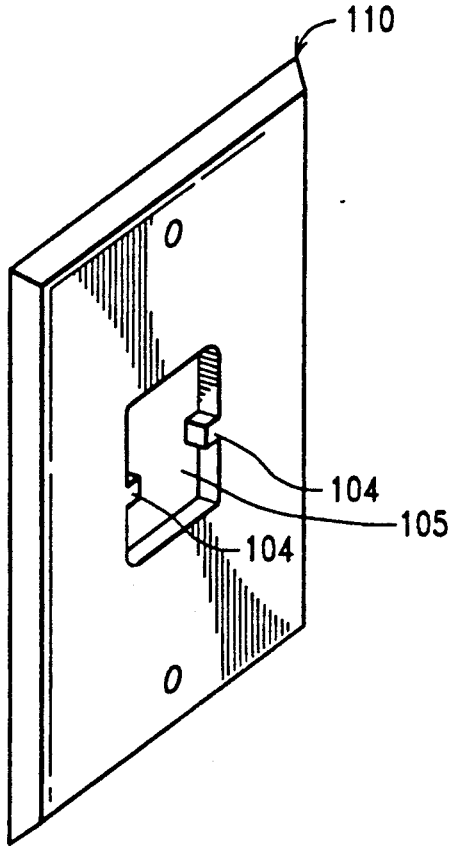
FIG. 10 shows a coverplate suitable for use in connection with the embodiment disclosed in FIG. 9.

FIG. 9 discloses a fourth embodiment of the invention in which jack 900 includes a flexible member 930 having an opening 940 therein rather than a protrusion. Similar to the other embodiments, flexible members 930 deflect into a plug-receiving cavity 950 of the jack when the jack is inserted or removed from its associated coverplate. In this embodiment, however, a different coverplate design is required and is shown in FIG. 10. Here, coverplate 110 has an opening 105 that is dimensioned to receive jack 900. The opening 105 in coverplate 110 includes protrusions 104 that interact with beveled faces 945 on flexible members 930. Admittedly, coverplate 110 has a less universal shape than the coverplate shown in FIG. 1 which is a regular rectangle without features. Nevertheless, it allows the design of a jack 900 without stop members that may be more easily removed from the coverplate when it is desirable to do so. And, as with the other embodiments, when a plug is inserted into plug-receiving cavity 950, it is nearly impossible to dissociate the jack from the coverplate.

Although various particular embodiments of the invention have been disclosed, various modifications are possible within its spirit and scope. Such modifications include, but are not limited to: (i) positioning the flexible member on a different surface of the jack; (ii) locating the stop member on the flexible member itself-notwithstanding the fact that this tends to complicate the molding process; (iii) positioning fixed end of the cantilever beam, which comprises the flexible member, toward the front or back or top or bottom of the jack; (iv) positioning the protrusion at the free end or at the fixed end of the cantilever beam; and (v) the use of more, or less, than two flexible members.

I claim:

1. An electrical connector receptacle for insertion into an opening of a receiving structure such as a coverplate, the connector receptacle comprising a plurality of surfaces including front, back, right side and left side, the receptacle being made from dielectric material having a cavity in the front surface thereof for receiving an electrical plug, the receptacle including a cantilever beam located on its right and left side surfaces; each cantilever beam having a free end positioned toward the back surface and adapted to deflect into the cavity and a fixed end positioned toward the front surface; whereby the free end of each cantilever beam is positioned to avoid interference with an electrical plug being inserted into the cavity through the front surface of the receptacle.

2. The receptacle of claim 1 wherein each cantilever beam includes an outwardly extending protrusion for deflecting it into the cavity of the receptacle during insertion into a receiving structure.

3. The receptacle of claim 2 further comprising an outwardly extending stop member for halting its progression through a receiving structure during insertion, the stop member being positioned between the protrusion on the cantilever beam and the back surface of the receptacle.

4. The receptacle of claim 2 wherein the protrusion is wedge shaped having a narrow portion at one end and a wide portion at the other end, said narrow portion being positioned toward the front surface of the receptacle and said wide portion being positioned toward the back surface of the receptacle.

5. A modular jack for making mechanical connection with a coverplate, the modular jack comprising a dielectric frame having a plurality of surfaces designated front, back, top, bottom, right side, and left side; the front surface including an opening into a first cavity for receiving an electrical plug therein, each side surface including a cantilever flexible member having a fixed end positioned towards the front surface of the dielectric frame and a free end positioned towards the back surface thereof, each flexible member having a wedge-shaped, outwardly-extending protrusion with a front portion and a relatively wider back portion, each protrusion being positioned so that its front and back portions are directionally aligned with the front and back surfaces of the dielectric frame, each flexible member being adapted to deflect into the first cavity when force is applied to the protrusion; whereby the free end of each flexible member is positioned to avoid interference with an electrical plug being inserted into the first cavity through the front surface of the frame.

6. The modular jack of claim 5 further comprising means for stopping the forward progress of the dielectric frame into a coverplate during insertion, said stopping means being positioned between the protrusion and the back side of the dielectric frame.

7. The modular jack of claim 5 further comprising a spring block, also made from dielectric material, containing a plurality of metallic spring contacts for making electrical contact with an electrical plug inserted into the first cavity, the spring block being inserted into a second cavity located on the back surface of the dielectric frame.

8. In combination:

A jack assembly for insertion into an opening of a receiving structure such as a coverplate, the jack assembly comprising a receptacle and a spring block, the receptacle including:

a first housing made from dielectric material and having a first cavity in a front surface thereof for receiving an electrical plug, and a second cavity in a back surface thereof for receiving the spring block;

a pair of cantilever beams, positioned of opposite side surfaces of the first housing that are adapted to deflect into the first cavity when the receptacle is inserted into a receiving structure, each cantilever beam having its free end positioned towards the back surface of the first housing and its fixed end positioned towards the front surface thereof to avoid interference with an electrical plug being inserted into the first cavity through the front surface, the spring block including:

a second housing made from dielectric material and having a plurality of grooves for supporting wires positioned thereiin; and a plurality of wires terminated in spring contacts and positioned within the grooves of the second housing.

* * * * *